US007611423B2

(12) United States Patent
Matsunaga et al.

(10) Patent No.: US 7,611,423 B2
(45) **Date of Patent: *Nov. 3, 2009**

(54) GOLF CLUB HEAD

(75) Inventors: Hideo Matsunaga, Saitama (JP); Wataru Ban, Saitama (JP); Hideo Shimazaki, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 426 days.

This patent is subject to a terminal disclaimer.

(21) Appl. No.: 11/434,191

(22) Filed: May 16, 2006

(65) Prior Publication Data

US 2007/0129165 A1 Jun. 7, 2007

(30) Foreign Application Priority Data

Dec. 5, 2005 (JP) ..... 2005-351279

(51) Int. Cl.
*A63B 53/04* (2006.01)

(52) U.S. Cl. ..... 473/329; 473/332; 473/349; 473/350

(58) Field of Classification Search ..... 473/324–350, 473/287–291

See application file for complete search history.

(56) References Cited

U.S. PATENT DOCUMENTS 2,846,228 A * 8/1958 Reach ..... 473/332
3,084,940 A * 4/1963 Cissel ..... 473/332
4,804,188 A 2/1989 McKee et al.
4,811,950 A 3/1989 Kobayashi
4,928,972 A * 5/1990 Nakanishi et al. ..... 473/332
5,290,036 A * 3/1994 Fenton et al. ..... 473/332
5,299,807 A 4/1994 Hutin
5,316,298 A 5/1994 Hutin et al.
5,316,305 A 5/1994 McCabe
5,351,958 A 10/1994 Helmstetter
5,362,055 A 11/1994 Rennie
5,409,229 A 4/1995 Schmidt et al.
5,411,255 A 5/1995 Kurashima et al.
5,431,396 A 7/1995 Shieh
5,492,327 A 2/1996 Biafore, Jr.
5,529,543 A * 6/1996 Beaumont, Sr. ..... 473/290
5,564,705 A 10/1996 Kobayashi et al.
5,586,947 A 12/1996 Hutin
5,643,111 A 7/1997 Igarashi
5,692,972 A 12/1997 Langslet
5,697,855 A * 12/1997 Aizawa ..... 473/350
5,703,294 A 12/1997 McConnell et al.
5,766,092 A 6/1998 Mimeur et al.
5,766,093 A * 6/1998 Rohrer ..... 473/329
6,045,456 A 4/2000 Best et al.
6,093,116 A 7/2000 Hettinger et al.

(Continued)

FOREIGN PATENT DOCUMENTS

EP 1757334 A1 2/2007

(Continued)

*Primary Examiner*—Sebastiano Passaniti
(74) *Attorney, Agent, or Firm*—Sughrue Mion, PLLC

(57) ABSTRACT

This invention provides a golf club head having a first viscoelastic body made of a first viscoelastic material and a second viscoelastic body made of a second viscoelastic material with a loss coefficient the temperature dependence of which is different from that of a loss coefficient of the first viscoelastic material.

9 Claims, 6 Drawing Sheets

U.S. PATENT DOCUMENTS

| | | | | |
|---|---|---|---|---|
| 6,265,475 | B1 | 7/2001 | Chifei et al. | |
| 6,302,807 | B1 * | 10/2001 | Rohrer | 473/329 |
| 6,431,997 | B1 * | 8/2002 | Rohrer | 473/324 |
| 6,616,546 | B2 | 9/2003 | Cho | |
| 6,642,308 | B2 | 11/2003 | Nomura et al. | |
| 6,672,975 | B1 | 1/2004 | Galloway | |
| 6,688,989 | B2 * | 2/2004 | Best | 473/332 |
| 6,743,114 | B2 * | 6/2004 | Best | 473/291 |
| 6,743,117 | B2 * | 6/2004 | Gilbert | 473/332 |
| 6,773,360 | B2 | 8/2004 | Willett et al. | |
| 6,780,123 | B2 | 8/2004 | Hasebe | |
| 6,835,144 | B2 * | 12/2004 | Best | 473/332 |
| 6,855,066 | B2 * | 2/2005 | Best | 473/291 |
| 6,902,495 | B2 * | 6/2005 | Pergande et al. | 473/332 |
| 6,984,180 | B2 | 1/2006 | Hasebe | |
| 6,991,559 | B2 | 1/2006 | Yabu | |
| 6,991,560 | B2 | 1/2006 | Tseng | |
| 7,048,647 | B2 | 5/2006 | Burrows | |
| 7,108,613 | B1 | 9/2006 | Gordon et al. | |
| 7,119,146 | B2 | 10/2006 | Tse et al. | |
| 7,182,698 | B2 | 2/2007 | Tseng | |
| 7,189,169 | B2 | 3/2007 | Billings | |
| 7,207,899 | B2 | 4/2007 | Imamoto | |
| 7,226,366 | B2 | 6/2007 | Galloway | |
| 7,303,485 | B2 * | 12/2007 | Tseng | 473/332 |
| 7,303,486 | B2 * | 12/2007 | Imamoto | 473/332 |
| 7,316,623 | B2 | 1/2008 | Imamoto | |
| 7,371,190 | B2 * | 5/2008 | Gilbert et al. | 473/332 |
| 2003/0027662 | A1 | 2/2003 | Werner et al. | |
| 2003/0092502 | A1 | 5/2003 | Pergande et al. | |
| 2004/0043830 | A1 | 3/2004 | Imamoto | |
| 2004/0053704 | A1 | 3/2004 | Gilbert | |
| 2004/0242339 | A1 * | 12/2004 | Gilbert et al. | 473/291 |
| 2005/0124437 | A1 | 6/2005 | Imamoto | |
| 2005/0148405 | A1 | 7/2005 | Imamoto | |
| 2005/0192116 | A1 | 9/2005 | Imamoto | |
| 2005/0197208 | A1 | 9/2005 | Imamoto | |
| 2006/0258480 | A1 * | 11/2006 | Hou et al. | 473/332 |
| 2007/0049400 | A1 | 3/2007 | Imamoto et al. | |
| 2007/0129160 | A1 | 6/2007 | Matsunaga et al. | |
| 2007/0129161 | A1 | 6/2007 | Matsunaga et al. | |
| 2007/0129162 | A1 | 6/2007 | Pan et al. | |
| 2007/0129164 | A1 | 6/2007 | Shimazaki et al. | |
| 2007/0129165 | A1 | 6/2007 | Matsunaga et al. | |
| 2007/0129166 | A1 | 6/2007 | Shimazaki et al. | |
| 2007/0129168 | A1 | 6/2007 | Matsunaga et al. | |
| 2007/0149313 | A1 | 6/2007 | Matsunaga et al. | |
| 2008/0020860 | A1 | 1/2008 | Imamoto | |

FOREIGN PATENT DOCUMENTS

| | | | |
|---|---|---|---|
| FR | 2717701 | A1 | 9/1995 |
| JP | 01-166779 | A | 6/1989 |
| JP | 05-028361 | U | 4/1993 |
| JP | 05147096 | A | 6/1993 |
| JP | 06-007486 | A | 1/1994 |
| JP | 06254183 | A | 9/1994 |
| JP | 06-319836 | A | 11/1994 |
| JP | 07-27630 | U | 5/1995 |
| JP | 07-148291 | A | 6/1995 |
| JP | 07-213656 | A | 8/1995 |
| JP | 08-206258 | A | 8/1996 |
| JP | 09-000666 | A | 1/1997 |
| JP | 09-122281 | A | 5/1997 |
| JP | 11114112 | A | 4/1999 |
| JP | 2000-116824 | A | 4/2000 |
| JP | 2000197718 | A | 7/2000 |
| JP | 2001000606 | A | 1/2001 |
| JP | 2001-170225 | A | 6/2001 |
| JP | 2004-313777 | A | 11/2001 |
| JP | 2003-093550 | A | 4/2003 |
| JP | 2003-102877 | A | 4/2003 |
| JP | 2003-250939 | A | 9/2003 |
| JP | 2003-265652 | A | 9/2003 |
| JP | 2003-265653 | A | 9/2003 |
| JP | 2003260153 | A | 9/2003 |
| JP | 2004-089434 | A | 3/2004 |
| JP | 2005-006763 | A | 1/2005 |
| JP | 2005-160947 | A | 6/2005 |
| JP | 2005-160948 | A | 6/2005 |
| JP | 3112038 | U | 6/2005 |
| JP | 2005-218510 | A | 8/2005 |
| JP | 2005-245519 | A | 9/2005 |
| JP | 2006000139 | A | 1/2006 |
| JP | 2006000435 | A | 1/2006 |
| WO | 9920358 | A1 | 4/1999 |

* cited by examiner

GOLF CLUB HEAD

FIELD OF THE INVENTION

The present invention relates to a golf club head and, more particularly, to a technique for controlling vibration of a golf club head by a viscoelastic body.

BACKGROUND OF THE INVENTION

A golf club head having a viscoelastic body has been proposed to improve the hitting impression or adjust the hitting sound on impact. When the viscoelastic body is attached, the vibration on impact is absorbed by the viscoelastic body to improve the hitting impression and decrease the hitting sound that is offensive to the player's ear. Japanese Utility Model Registration No. 3112038 discloses a golf club head having a plurality of types of elastic weights having different specific gravities and elasticities. Japanese Patent Laid-Open No. 2004-313777 discloses a golf club head having a plurality of types of elastic bodies having different hardnesses.

The present inventors inspected the resonance frequency of a golf club head alone. A plurality of resonance frequencies were confirmed in a range of approximately 4,000 Hz to 10,000 Hz. Therefore, to reduce the vibration of the golf club head effectively, it is desired to attach a viscoelastic body that can reduce the vibration within a wide frequency range to the golf club head. In general, however, there is a limit to the frequency range of a viscoelastic material that is effective to reduce vibration depending on the material. The present inventors also inspected the resonance frequency of the golf club as a whole. A plurality of resonance frequencies were confirmed in a range of approximately 2,000 Hz or less. Therefore, to reduce the vibration of the golf club as a whole, the vibration is preferably reduced within a wider frequency range.

SUMMARY OF THE INVENTION

The present invention has been made in order to overcome the deficits of prior art.

According to the aspects of the present invention, there is provided a golf club head having a first viscoelastic body made of a first viscoelastic material and a second viscoelastic body made of a second viscoelastic material with a loss coefficient a temperature dependence of which is different from that of a loss coefficient of the first viscoelastic material.

The temperature dependence of the loss coefficient (so-called tan δ) of a viscoelastic material represents the degree of the vibration attenuating effect of the viscoelastic material at any given temperature, and is related to the degree of the vibration attenuating effect of the viscoelastic material at any given frequency. More specifically, relatively, whereas a viscoelastic material with a large loss coefficient at a low temperature provides a high vibration attenuating effect in a high frequency band, a viscoelastic material with a large loss coefficient at a high temperature provides a high vibration attenuating effect in a low frequency band.

Therefore, a plurality of types of viscoelastic materials with loss coefficients the temperature dependences of which are different are employed simultaneously, to reduce vibration in a wider frequency range.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Figure 1:
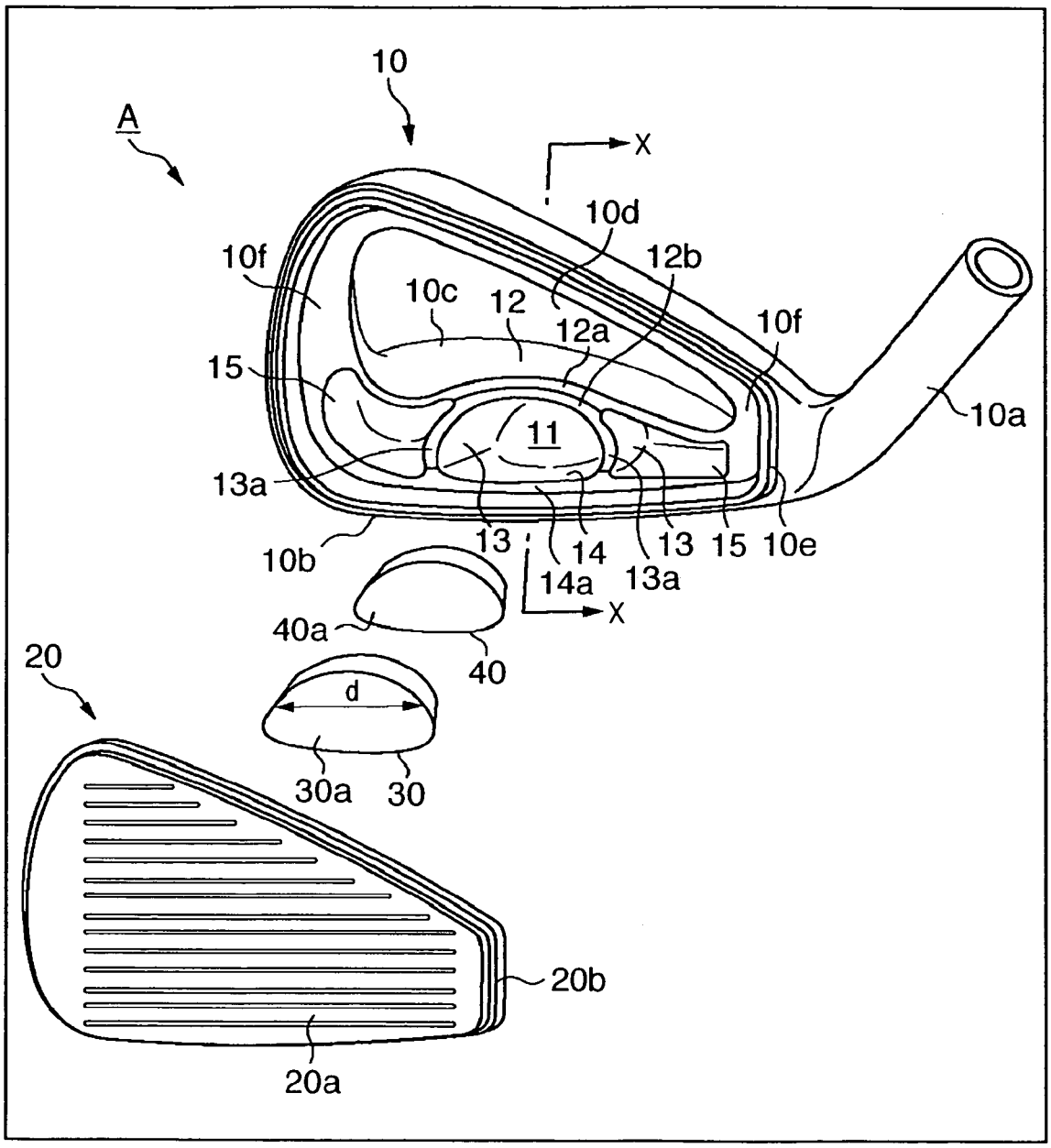
FIG. 1 is an exploded perspective view of a golf club head A according to one embodiment of the present invention.
Figure 2A:
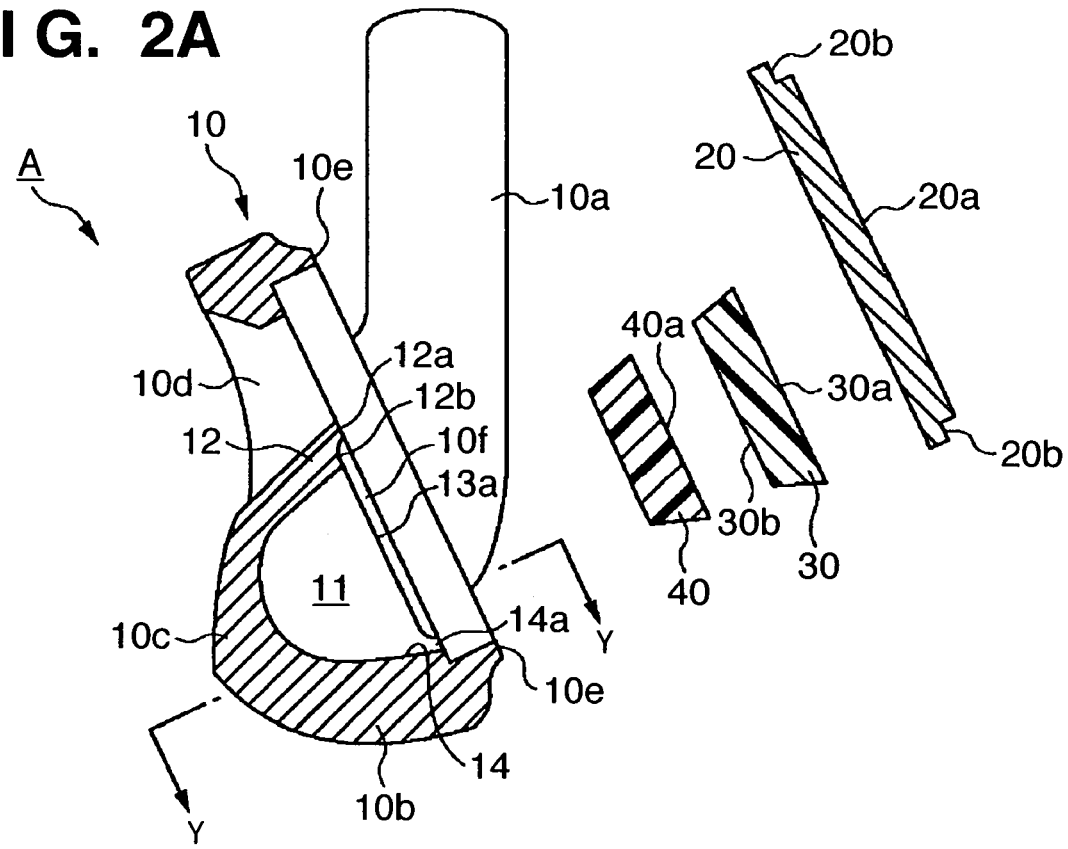
FIG. 2A is a sectional view of the golf club head A in an exploded state taken along the line X-X of FIG. 1.
Figure 2B:
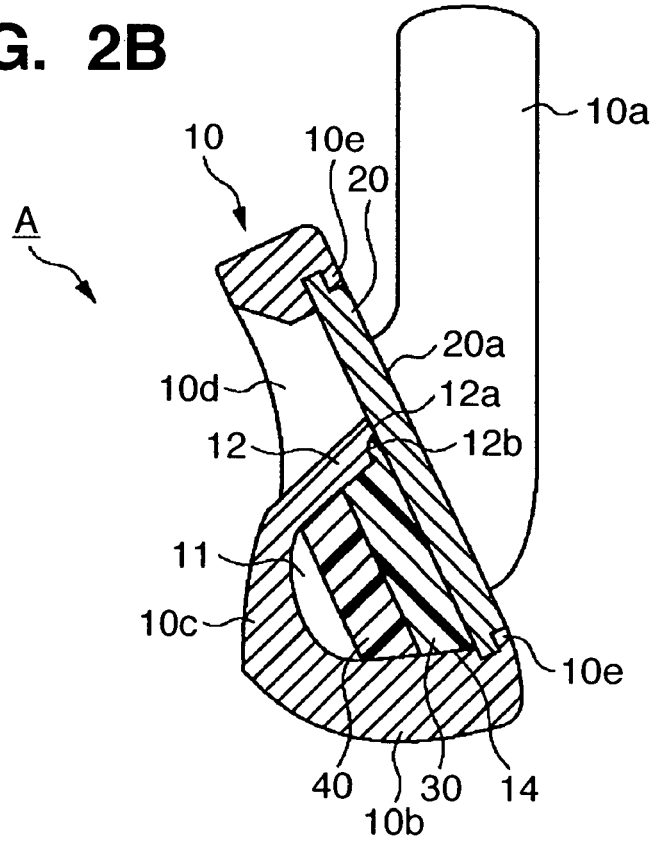
FIG. 2B is a sectional view of the golf club head A in an assembled state taken along the line X-X of FIG. 1.
Figure 3:
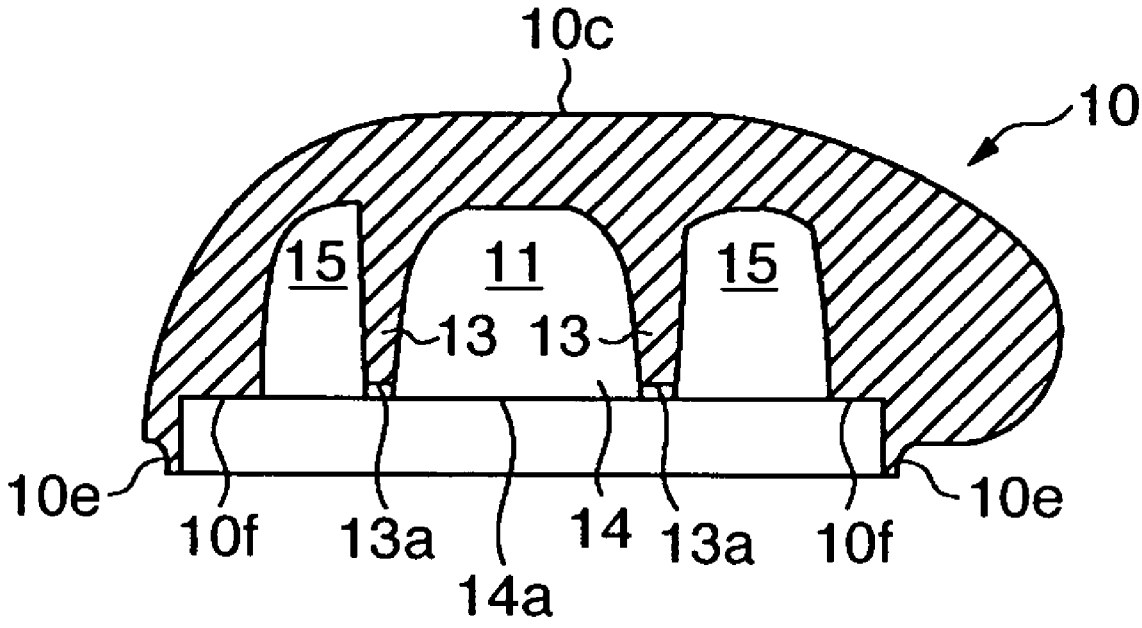
FIG. 3 is a sectional view taken along the line Y-Y of FIG. 2A.

FIG. 1 is an exploded perspective view of a golf club head A according to one embodiment of the present invention, FIG. 2A is a sectional view of the golf club head A in an exploded state taken along the line X-X of FIG. 1, FIG. 2B is a sectional view of the golf club head A in an assembled state taken along the line X-X of FIG. 1, and FIG. 3 is a sectional view taken along the line Y-Y of FIG. 2A.

The golf club head A is an iron type golf club head and includes a head main body 10 and a face plate 20 which is fixed to the front surface side of the head main body 10 to form a face surface 20*a*. Although this embodiment is exemplified by an iron type golf club head, the present invention can also be applied to another type of golf club head.

The head main body 10 integrally has a hosel portion 10*a* to be connected to a shaft, a sole portion 10*b*, and a back portion 10*c*, and is made of, e.g., stainless steel or soft iron. An opening 10*d* is formed in the upper portion of the head main body 10 to extend from the front surface side to the rear surface side, thus decreasing the weight and lowering the barycenter of the head main body 10. A rib 10*e* which defines the space where the face plate 20 is to be fixed and a contacting portion 10*f* with which the rear surface of the face plate 20 is to contact is formed on the front surface of the head main body 10.

The face plate 20 is formed with the face surface 20*a* on its front surface and a stepped portion 20*b* formed at its circumference. The rear surface of the face plate 20 forms a flat surface. For example, the face plate 20 is made of stainless steel, maraging steel, brass, a copper alloy (e.g., beryllium copper or bronze), titanium, a titanium alloy, duralumin, an amorphous metal, an FRM, or the like.

A cavity portion 11 is formed in the head main body 10 to open to the face plate 20 side and be closed on the back portion 10*c* side. The cavity portion 11 is defined by circumferential walls 12 to 14 integrally formed with the head main body 10. Of the end faces on the face plate 20 side of the circumferential walls 12 to 14, that end face of the circumferential wall 12 which is above cavity portion 11 has an contacting portion 12*a* which is flush with the contacting portion 10*f* and contacts with the rear surface of the face plate 20, and a non-contacting portion 12*b* which is spaced apart from the rear surface of the face plate 20 inside the contacting portion 12*a*. The end face of the circumferential wall 14 which is at the bottom of the cavity portion 11 comprises only an contacting portion 14*a* which is flush with the contacting portion 10*f* and contacts with the rear surface of the face plate 20. Those end faces of the circumferential wall 13 which are on the two sides of the cavity portion 11 have non-contacting portions 13*a* which are spaced apart from the rear surface of the face plate 20 and flush with the non-contacting portion 12*b*. Unlike the non-contacting portion 12*b*, the non-contacting portions 13*a* are formed throughout the entire range in the direction of thickness of the circumferential wall 13.

Second cavity portions 15 are formed on the two sides of the cavity portion 11. The cavity portions 15 serve to decrease the weight of the head main body 10. Although the cavity portions 15 are formed on the two sides of the cavity portion 11 in this embodiment, the cavity portion 15 can be formed on only one side of the cavity portion 11. Although the cavity portions 15 are left hollow in this embodiment, weights or the like to adjust the barycentric position of the golf club head A can be inserted in the cavity portions 15.

A first viscoelastic body 30 and second viscoelastic body 40 are inserted in a compressed state in the space formed by the cavity portion 11 and face plate 20. A front surface 30*a* of the first viscoelastic body 30 is in tight contact with the rear surface of the face plate 20. The second viscoelastic body 40 is arranged behind the first viscoelastic body 30, and its front surface 40*a* is in tight contact with a rear surface 30*b* of the first viscoelastic body 30.

The first viscoelastic body 30 and second viscoelastic body 40 are made of viscoelastic materials with loss coefficients (so-called tan δ) the temperature dependences of which are different. The temperature dependence of the loss coefficient of a viscoelastic material represents the degree of the vibration attenuating effect of the viscoelastic material at any given temperature, and is related to the degree of the vibration attenuating effect of the viscoelastic material at any given frequency. More specifically, relatively, whereas a viscoelastic material with a large loss coefficient at a low temperature provides a large vibration attenuating effect in a high frequency band, a viscoelastic material with a large loss coefficient at a high temperature provides a high vibration attenuating effect in a low frequency band. According to this embodiment, the first viscoelastic body 30 and second viscoelastic body 40 made of viscoelastic materials with loss coefficients the temperature dependences of which are different from each other are employed simultaneously, to reduce vibration in a wider frequency range.

Examples of viscoelastic materials that form the first viscoelastic body 30 and second viscoelastic body 40 include IIR (butyl bromide composition), NBR (acrylonitrile-butadiene rubber), natural rubber, silicone rubber, styrene-based rubber, and the like. The first viscoelastic body 30 and second viscoelastic body 40 can also be formed by mixing a metal powder or the like in the viscoelastic materials described above to adjust their specific gravities.

Desirably, the first viscoelastic body 30 and second viscoelastic body 40 are made of viscoelastic materials with loss coefficients the peak value temperatures of which are different. In general, the loss coefficient of a viscoelastic material gradually decreases at each temperature with respect to the peak value temperature as a peak. Therefore, when viscoelastic materials with loss coefficients the peak value temperatures of which are different are employed simultaneously, vibration in a wider frequency range can be reduced.

Both the first viscoelastic body 30 and second viscoelastic body 40 are desirably made of viscoelastic materials with loss coefficients the peak values of which are 0.3 or more. If the loss coefficients are 0.3 or more, a higher vibration attenuating effect can be obtained.

Desirably, the peak value temperatures of the loss coefficients of one and the other of the viscoelastic material that forms the first viscoelastic body 30 and the viscoelastic material that forms the second viscoelastic body 40 are respectively less than −30° C. and −30° C. or more. The viscoelastic material with the loss coefficient the peak value temperature of which is less than −30° C. provides a relatively high vibration attenuating effect in the high frequency band, and the viscoelastic material with the loss coefficient the peak value temperature of which is −30° C. or more provides a relatively high vibration attenuating effect in the low frequency band. Therefore, vibration in a wider frequency range can be reduced.

The peak value temperature of the loss coefficient of the viscoelastic material that forms the first viscoelastic body 30 is desirably lower than that of the loss coefficient of the viscoelastic material that forms the second viscoelastic body 40. It is assumed that the frequency of the vibration of the golf club head A on impact is highest in the face plate 20 and gradually decreases as it is farther away from the face plate 20. When a viscoelastic material with a loss coefficient the peak value temperature of which is relatively low is used as the viscoelastic material to form the first viscoelastic body 30 which is in tight contact with the face plate 20, the high frequency vibration occurring in the face plate 20 can be reduced more effectively. When a viscoelastic material with a loss coefficient the peak value temperature of which is relatively high is used as the viscoelastic material to form the second viscoelastic body 40 which is away from the face plate 20, the low frequency vibration that occurs in a portion away from the face plate 20 can be reduced more effectively.

When assembling the golf club head A having the above structure, first, the first viscoelastic body 30 and second viscoelastic body 40 are inserted in the cavity portion 11 of the head main body 10. Then, as shown in FIG. 2B, the face plate 20 is inserted in the space of the head main body 10 defined by the rib 10*e* such that the rear surface of the face plate 20 tightly contacting with the contacting portion 10*f* of the head main body 10. After that, the rib 10*e* is caulked with the stepped portion 20*b* of the face plate 20 to fix the face plate 20 to the head main body 10. The first viscoelastic body 30 and second viscoelastic body 40 are designed in size such that they are compressed in the cavity portion 11.

In the golf club head A according to this embodiment, the first viscoelastic body 30 and second viscoelastic body 40 which are made of the viscoelastic materials with loss coefficients the temperature dependences of which are different from each other are employed simultaneously to reduce vibration in a wider frequency range. As the first viscoelastic body 30 and second viscoelastic body 40 are disposed within the golf club head A, they do not expose outside. As the first viscoelastic body 30 and second viscoelastic body 40 are protected by the head main body 10 and face plate 20, they will not be damaged. As the first viscoelastic body 30 and second viscoelastic body 40 are inserted in a compressed state in the space defined by the cavity portion 11 and face plate 20, the first viscoelastic body 30 and second viscoelastic body 40 come into tight contact with the golf club head A to enhance the vibration reducing effect.

When the non-contacting portions 12*b* and 13*a* are formed on the end faces of the circumferential walls 12 and 13 that define the cavity portion 11, a gap communicating with the cavity portion 11 is formed in the end faces of the circumferential walls 12 and 13. Thus, a part of the first viscoelastic body 30 in a compressed state is allowed to extend into the gap.

FIG. 2B shows a state wherein part of the first viscoelastic body 30 extends into the gap between the non-contacting portion 12*b* and face plate 20. Even if the compression margins of the first viscoelastic body 30 and second viscoelastic body 40 are increased, when fixing the face plate 20 to the head main body 10, the head main body 10 and face plate 20 can be prevented from biting into the first viscoelastic body 30. Particularly, in this embodiment, as the gap formed by the non-contacting portions 13*a* communicates not only with the cavity portion 11 but also with the cavity portions 15, the allowable extension amount of the first viscoelastic body 30 increases, so that the head main body 10 and face plate 20 can be more prevented from biting into the first viscoelastic body 30. Since part of the first viscoelastic body 30 extends into the gap between the non-contacting portions 12*b* and 13*a* and face plate 20, the tight contact area between the first viscoelastic body 30 and face plate 20 also increases more.

According to this embodiment, the front surface 30*a* and rear surface 30*b* of the first viscoelastic body 30 are parallel to each other to form a plate which has a uniform thickness except for its circumferential portion. The front surface 40*a* of the second viscoelastic body 40 forms a flat surface that contacts with against the rear surface of the first viscoelastic body 30. The first viscoelastic body 30, second viscoelastic body 40, and cavity portion 11 are designed in shape such that their front surface 30*a*, rear surface 30*b*, and front surface 40*a* are parallel to the rear surface of the face plate 20. With this structure, the front surface 30*a* of the first viscoelastic body 30 comes into tight contact with the rear surface of the face plate 20 with a substantially uniform pressure, thus improving the tight contact state.

In this embodiment, the cavity portion 11 is formed in the lower side of the head main body 10, and the first viscoelastic body 30 loaded in the cavity portion 11 is located in the lower side of the head main body 10. This structure can lower the barycentric position of the golf club head A, thus achieving a low barycenter. An iron type golf club hits a golf ball with its point close to the lower portion of the face surface 20*a*. Thus, the first viscoelastic body 30 and second viscoelastic body 40 are located substantially behind the position of the golf ball hitting point, so that the vibration damping effect of the first viscoelastic body 30 and second viscoelastic body 40 can improve.

In this embodiment, the width (d in FIG. 1) in a direction along the face plate 20 of the first viscoelastic body 30 increases downward from its upper portion, and the cavity portion 11 has a shape to match this. Hence, the barycentric position of the first viscoelastic body 30 is low. This can lower the barycentric position of the golf club head A, thus further achieving a low barycenter.

In this embodiment, the viscoelastic bodies are disposed behind the face plate 20. However, the positions to dispose the viscoelastic bodies are not limited to this, but the viscoelastic bodies can be attached to various portions. The first viscoelastic body 30 and second viscoelastic body 40 need not be in contact with each other, and can be disposed separately.

According to this embodiment, two viscoelastic bodies are mounted in the golf club head. However, the present invention is not limited to this, and three or more viscoelastic bodies can be mounted in the golf club head. In this case, the viscoelastic materials that form the respective viscoelastic bodies desirably have loss coefficients the temperature dependences of which are different from each other. FIGS. 4A to 4D are views showing such examples. The resonance frequency of the vibration of a golf club head differs depending on the position of the golf ball hitting point. In the examples of FIGS. 4A to 4D, viscoelastic bodies are disposed in accordance with the position of the golf ball hitting point, so as to be effective in reducing vibration of various types of resonance frequencies, thus coping with vibration in a wide frequency range.

Figure 4A:
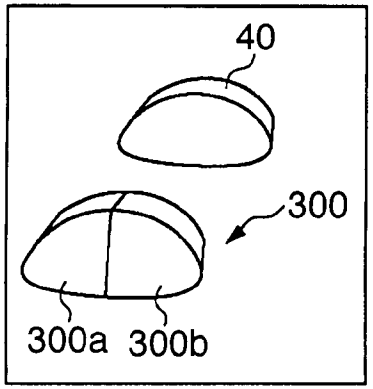
FIGS. 4A to 4E are views showing examples of a viscoelastic body to be loaded in the golf club head A.

In FIG. 4A, a viscoelastic body 300 which replaces the first viscoelastic body 30 is horizontally divided to form viscoelastic bodies 300*a* and 300*b* that are made of viscoelastic materials with loss coefficients the temperature dependences of which are different. Accordingly, in this example, three viscoelastic bodies are mounted in a golf club head, which have loss coefficients the temperature dependences of which are different. This structure copes with a golf club head that generates vibration of different frequencies between cases wherein the position of the golf ball hitting point is close to the heel and is close to the toe.

Figure 4B:
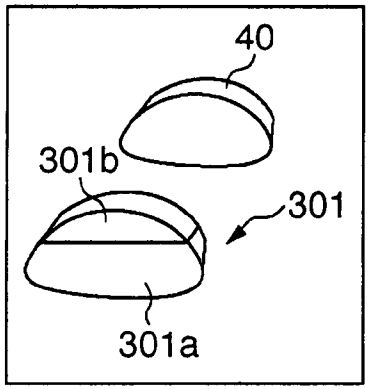

In FIG. 4B, a viscoelastic body 301 which replaces the first viscoelastic body 30 is vertically divided to form viscoelastic bodies 301*a* and 301*b* that are made of viscoelastic materials with loss coefficients the temperature dependences of which are different. Accordingly, in this example as well, three viscoelastic bodies are mounted in a golf club head, which have loss coefficients the temperature dependences of which are different. This structure copes with a golf club head that generates vibration of different frequencies between cases wherein the position of the golf ball hitting point is on the upper side and is on the lower side.

Figure 4C:
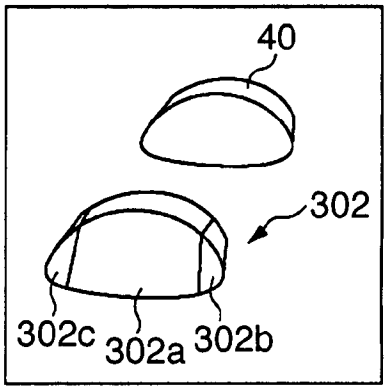

In FIG. 4C, a viscoelastic body 302 which replaces the first viscoelastic body 30 is horizontally divided into three portions to form viscoelastic bodies 302*a*, 302*b*, and 302*c*. Accordingly, in this example, four viscoelastic bodies are mounted in a golf club head, which have loss coefficients the temperature dependences of which are different. This structure copes with a golf club that generates vibration of different frequencies among cases wherein the position of the golf ball hitting point is in the vicinity of the so-called sweet spot, is close to the heel, and is close to the toe.

Figure 4D:
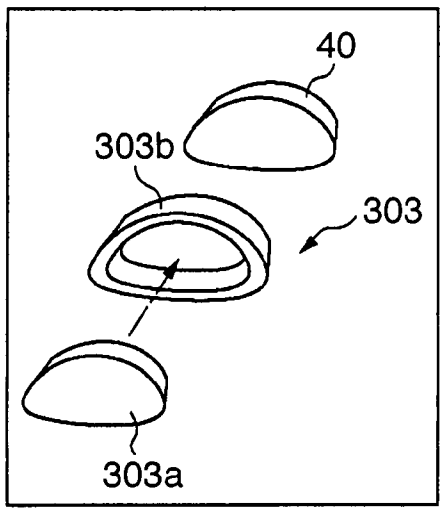

In FIG. 4D, a viscoelastic body 303 which replaces the first viscoelastic body 30 is divided in the direction of its thickness. A viscoelastic body 303*b* is configured to cover the circumferential surface and rear portion of a viscoelastic body 303*a*. Accordingly, in this example as well, three viscoelastic bodies are mounted in a golf club head, which have loss coefficients the temperature dependences of which are different. This structure copes with a golf club head that generates vibration of different frequencies between a case wherein the position of the golf ball hitting point is in the vicinity of the so-called sweet spot, and the other cases.

Figure 4E:
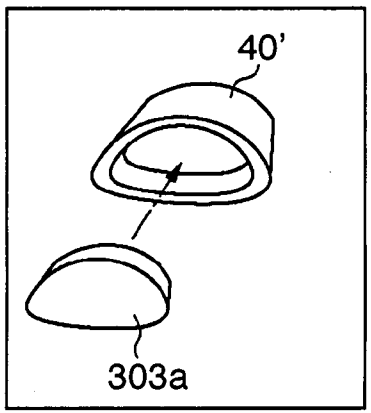

In FIG. 4E, two viscoelastic bodies are mounted in a golf club head. In FIG. 4E, the case of FIG. 4D is modified by integrating the viscoelastic body 303*b* and the second viscoelastic body 40 to form a viscoelastic body 40'.

EXAMPLE & COMPARATIVE EXAMPLES

The golf club head A shown in FIG. 1 was subjected to comparison tests. The viscoelastic materials of the first viscoelastic body 30 and second viscoelastic body 40 used in the example of the present invention and its comparative examples are as follows.

Example

Butyl bromide composition (the temperature dependence of the loss coefficient differs between the first viscoelastic body 30 and second viscoelastic body 40.)

Comparative Example 1

Styrene-based thermoplastic elastomer (the temperature dependence of the loss coefficient is the same between the first viscoelastic body 30 and second viscoelastic body 40.)

Comparative Example 2

Acrylonitrile-butadiene rubber (the temperature dependence of the loss coefficient is the same between the first viscoelastic body 30 and second viscoelastic body 40.)

Comparative Example 3

Neither the first viscoelastic body 30 nor the second viscoelastic body 40 is inserted.

Figure 5A:
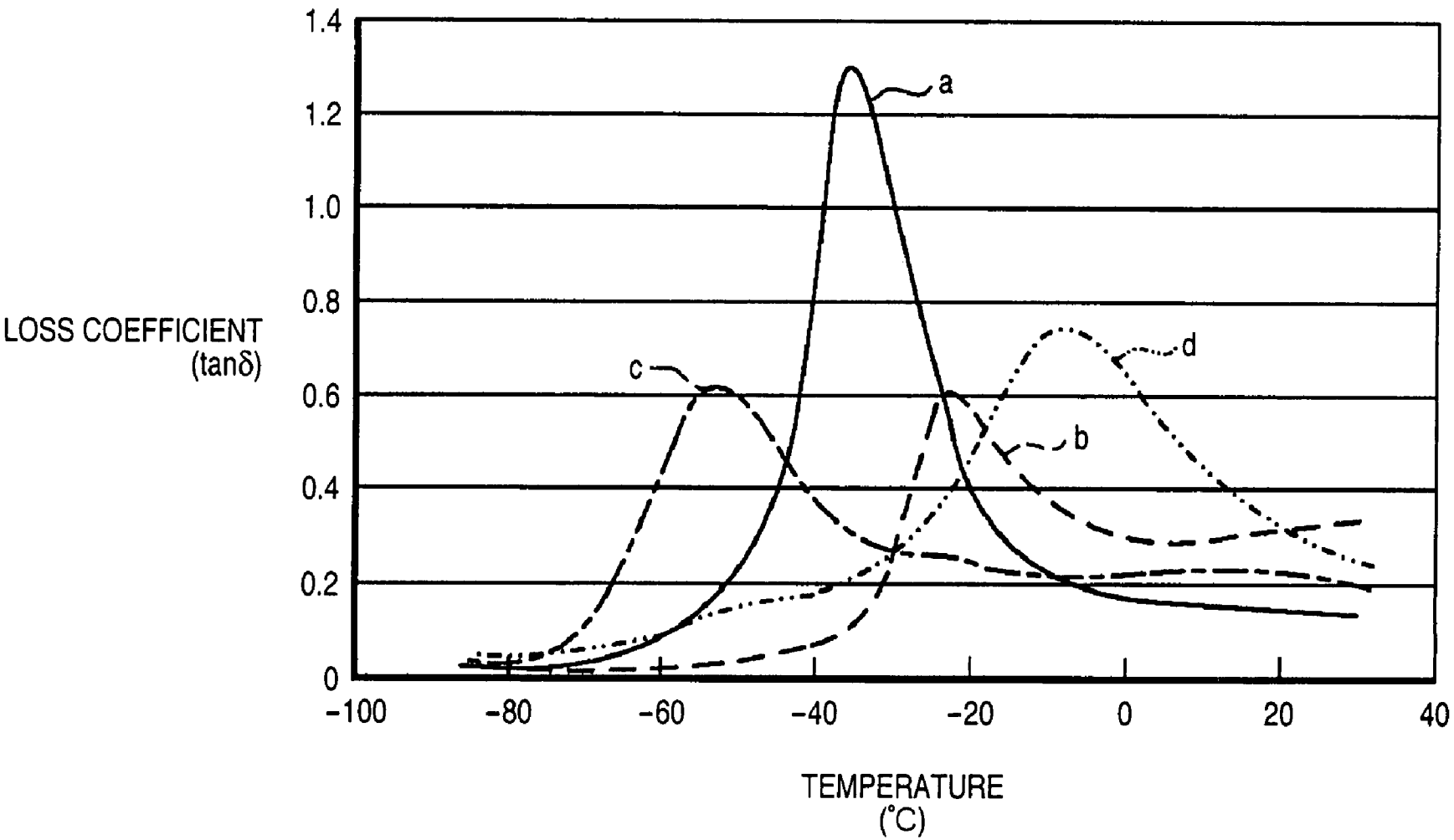
FIG. 5A is a graph showing the temperature dependences of the loss coefficients of the respective viscoelastic materials used in comparative experiments.

FIG. 5A is a graph showing the temperature dependences of the loss coefficients of the respective viscoelastic materials used in the experiments, and shows the temperature dependences at the vibration of 1 Hz. Referring to FIG. 5A, a line a represents the temperature dependence of the loss coefficient of the viscoelastic material (butyl bromide composition) used to form the first viscoelastic body 30 of the example. A line b represents the temperature dependence of the loss coefficient of the viscoelastic material (butyl bromide composition) used to form the second viscoelastic body 40 of the example. A line c represents the temperature dependence of the loss coefficient of the viscoelastic material (styrene-based thermoplastic elastomer) used to form the first viscoelastic body 30 and second viscoelastic body 40 of Comparative Example 1. A line d represents the temperature dependence of the loss coefficient of the viscoelastic material (acrylonitrile-butadiene rubber) used to form the first viscoelastic body 30 and second viscoelastic body 40 of Comparative Example 2.

The respective viscoelastic materials used to form the first viscoelastic body 30 and second viscoelastic body 40 of the example have loss coefficients the peak value temperatures of which are different, and the peak values of their loss coefficients are both 0.3 or more. The peak value temperature of the loss coefficient of the viscoelastic material of the first viscoelastic body 30 is less than −30° C. The peak value temperature of the loss coefficient of the viscoelastic material of the second viscoelastic body 40 is −30° C. or more.

Figure 5B:
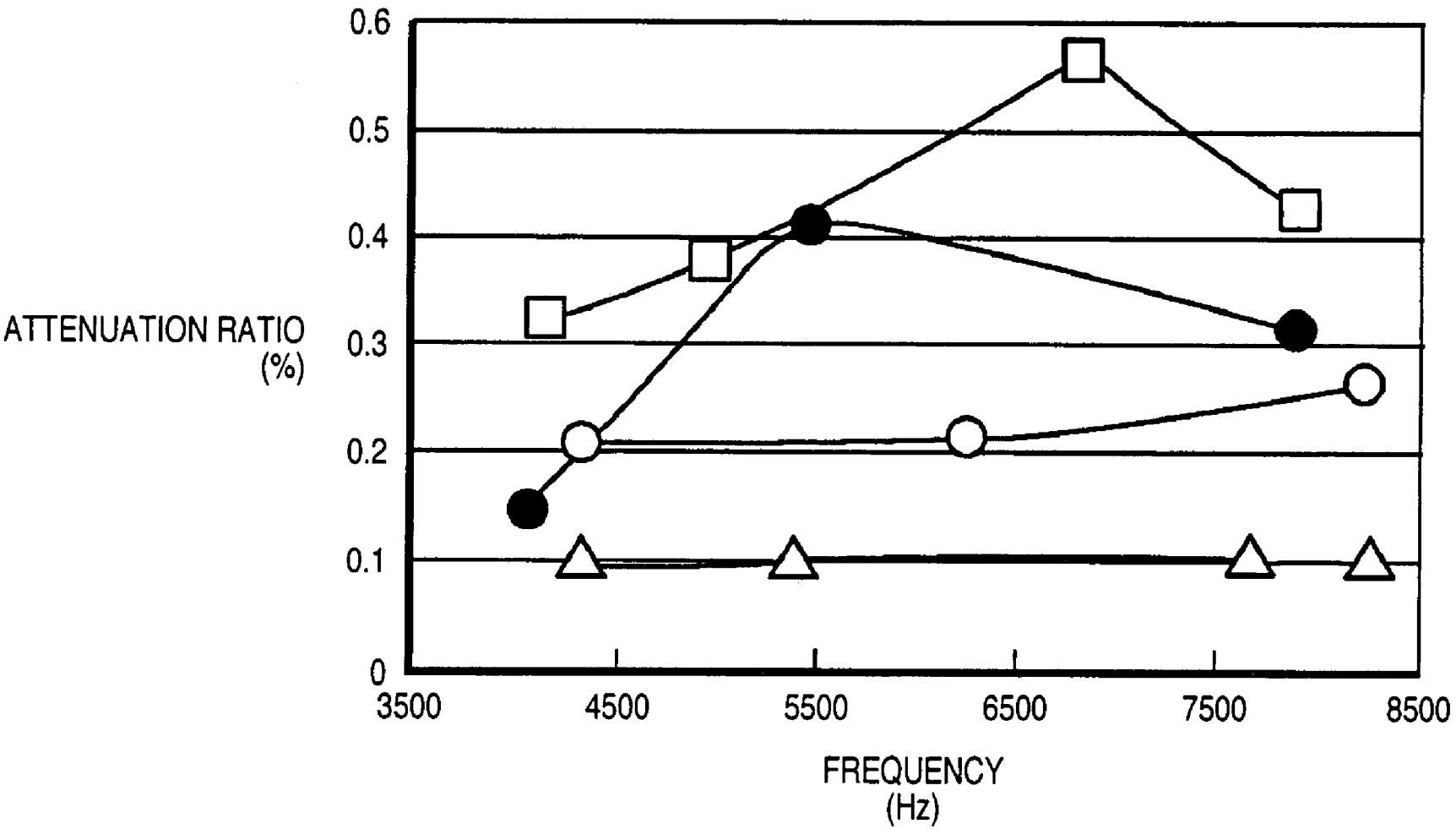
FIG. 5B is a graph showing the result of the vibration measurement experiment for golf club heads according to the example and Comparative Examples 1 to 3.

FIG. 5B is a graph showing the result of the vibration measurement experiment for golf club heads according to the example and Comparative Examples 1 to 3. In FIG. 5B, the attenuation ratios are calculated by modal analysis. The plots in FIG. 5B indicate the attenuation ratios of the resonance frequencies of the respective golf club heads. Square plots indicate the example, solid circle plots indicate Comparative Example 1, blank circle plots indicate Comparative Example 2, and triangular plots indicate Comparative Example 3. In the example, a high attenuation ratio is obtained in a wide frequency range.

As many apparently widely different embodiments of the present invention can be made without departing from the spirit and scope thereof, it is to be understood that the invention is not limited to the specific embodiments thereof except as defined in the appended claims.

This application claims the benefit of Japanese Application No. 2005-351279, filed Dec. 5, 2005, which is hereby incorporated by reference herein in its entirety.

What is claimed is:

1. An iron type golf club head comprising:

a head main body;

a face plate fixed to a front surface side of said head main body to form a face surface;

a cavity portion formed in said head main body, said cavity portion open to the front surface side; and a plurality of viscoelastic bodies disposed within said cavity portion, wherein said plurality of viscoelastic bodies are made of viscoelastic materials with loss coefficients the temperature dependences of which are different, wherein said plurality of viscoelastic bodies are arranged along a rear surface of said face plate, and wherein each viscoelastic body is in tight contact with the rear surface of said face plate.

2. The head according to claim 1, wherein said plurality of viscoelastic bodies are arranged in a toe-heel direction.

3. The head according to claim 1, wherein said plurality of viscoelastic bodies are arranged in a vertical direction.

4. The head according to claim 1, wherein an axial edge on the front surface of a circumferential wall defining said cavity portion comprises:

a contacting portion that contacts the rear surface of said face plate; and a non-contacting portion spaced apart from the rear surface of said face plate to form a gap between said non-contacting portion and the rear surface of said face plate.

5. The head according to claim 1, further comprising a rear viscoelastic body disposed behind the plurality of viscoelastic bodies within said cavity portion.

6. An iron type golf club head comprising:

a head main body;

a face plate fixed to a front surface side of said head main body to form a face surface;

a cavity portion formed in said head main body, said cavity portion open to the front surface side;

a first viscoelastic body disposed within said cavity portion; and a second viscoelastic body disposed within said cavity portion, wherein said first and second viscoelastic bodies are made of viscoelastic materials with loss coefficients the temperature dependences of which are different, wherein said second viscoelastic body includes a portion covering a circumferential surface of said first viscoelastic body, and wherein said first viscoelastic body and said portion of said second viscoelastic body are in tight contact with a rear surface of said face plate.

7. The head according to claim 6, wherein said second viscoelastic body includes another portion covering a rear portion of said first viscoelastic body.

8. The head according to claim 6, wherein an axial edge on the front surface of a circumferential wall defining said cavity portion comprises:

a contacting portion that contacts the rear surface of said face plate; and a non-contacting portion spaced apart from the rear surface of said face plate to form a gap between said non-contacting portion and the rear surface of said face plate.

9. The head according to claim 6, further comprising a rear viscoelastic body disposed behind said first and second viscoelastic bodies within said cavity portion.

* * * * *